United States Patent [19]

Gabrielian

[11] Patent Number: 4,547,016

[45] Date of Patent: Oct. 15, 1985

[54] QUICK RELEASE MOUNTING

[75] Inventor: Henry Gabrielian, Newport Beach, Calif.

[73] Assignee: EECO Incorporated, Santa Ana, Calif.

[21] Appl. No.: 640,298

[22] Filed: Aug. 13, 1984

[51] Int. Cl.[4] ..... A47C 7/62

[52] U.S. Cl. ..... 297/194; 292/303; 248/27.3

[58] Field of Search ..... 297/194; 292/303, 86; 248/27.3, 231.4; 49/463, 465; 403/252, 254, 253

[56] References Cited

U.S. PATENT DOCUMENTS

| | | | |
|---|---|---|---|
| 299,276 | 5/1884 | Shaw et al. | 292/303 |
| 419,846 | 1/1890 | Gamble | 292/303 |
| 2,495,557 | 1/1950 | Walsh | 49/463 |
| 2,573,984 | 11/1951 | Parker et al. | 292/303 |
| 3,170,268 | 2/1965 | Balzer et al. | 49/463 |
| 3,659,037 | 4/1972 | MacDonald | 248/27.3 |
| 3,792,551 | 2/1974 | Hallas | 49/463 |
| 3,905,712 | 9/1975 | McConnell | 292/303 |
| 3,908,730 | 9/1975 | Goss, Jr. et al. | 49/465 |
| 4,165,944 | 8/1979 | Sunasky | 403/254 |
| 4,190,284 | 2/1980 | Schmidhuber et al. | 297/194 |

*Primary Examiner*—Francis K. Zugel

*Attorney, Agent, or Firm*—Harry R. Lubcke

[57] ABSTRACT

A latch for placing within an aperture, the latch having oppositely disposed lips to fit within the aperture; one lip including a leaf spring. The spring is flexed by inserting a rod in an orifice at the extremity of the latch for inserting or removing the latch from the aperture.

5 Claims, 2 Drawing Figures

QUICK RELEASE MOUNTING

TECHNICAL FIELD

This invention pertains to a locking latch having one leaf spring member.

BACKGROUND ART

U.S. Pat. No. 245,786, issued Aug. 16, 1881 to L. A. Centlivre, entitled "Box Fastener", discloses an in-box latch having a compression spring that can be released by inserting a pencil or the equivalent through a hole in the front of the box. The box is proposed for shipping beer.

U.S. Pat. No. 742,563, issued Oct. 27, 1903 to C. W. Beehler, entitled "Box Fastener", discloses an in-box latch having a spring wire movable member and a semi-hook stationary sheet metal member coacting to retain the lid of a box closed until a pencil or the equivalent is passed through an adjacent hole in the box to push the movable member away from the sheet metal member.

This manual effort overcomes the retaining force of the spring wire member.

SUMMARY OF THE INVENTION

A latch structure (1) for removable placement within an aperture (5,5'); the structure having oppositely extending lips to engage opposite sides of the aperture. A spring (6) normally abutting a side of the aperture is suited to be flexed away therefrom to allow the latch structure to be translated away from a side (4) of the aperture and thereafter to be lifted out, at right angles, therefrom. The spring is flexed by inserting a rod (8) in an orifice (7) to bear upon the spring.

DESCRIPTION OF THE PREFERRED EMBODIMENT

Figure 1:
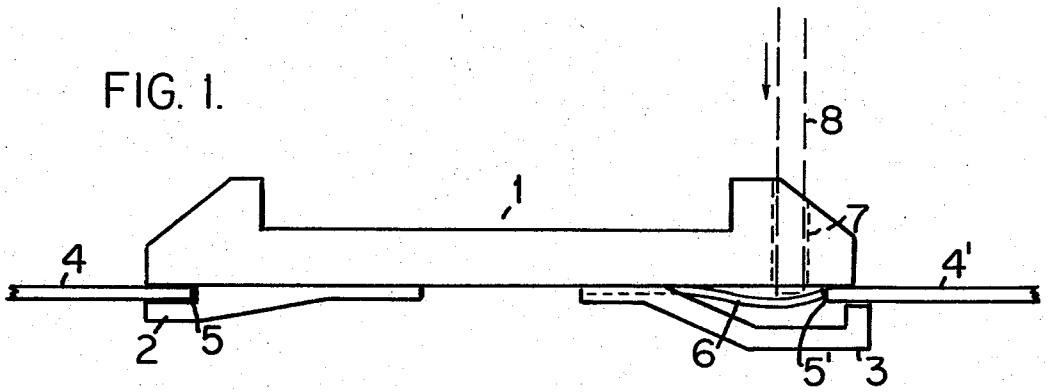
FIG. 1 is a side elevation of the latch structure shown within an aperture.
Figure 2:
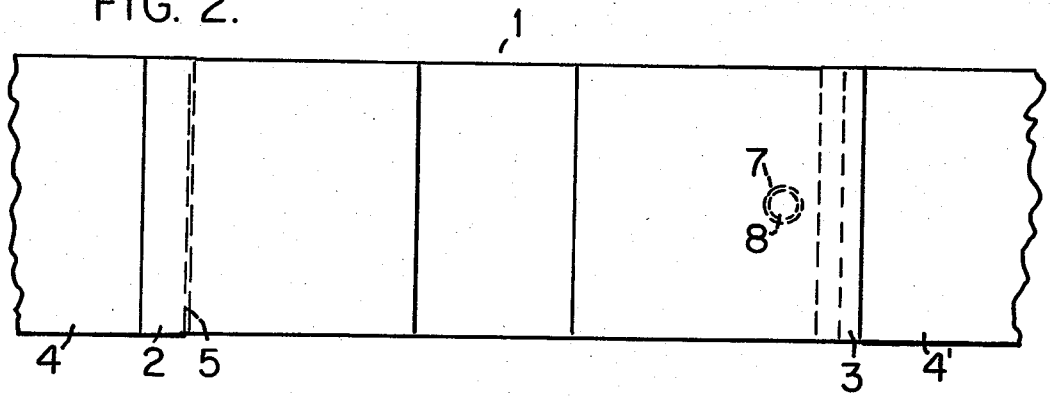
FIG. 2 is a bottom plan view of the same.

This latch structure can be embodied in a wide range of sizes, shapes, and for carrying various elements. However, it is typically embodied in a rectangular shape and is proportioned to fit in the seat arm of a vehicle, such as an airplane, to carry entertainment and attendant-call controls.

The invention is concerned with the elements that retain the latch in place, and those that come into play to remove the latch from the aperture in the seat arm.

In the figures, latch structure 1 is to be regarded as the frame or minimum configuration of the auxiliary structure coactive with the inventive elements. Lip 2 engages surface 4 in which the aperture is formed, at that aperture.

At the opposite end a locking-unlocking spring, in leaf form, 6, locks structure 1 in surface aperture 4. When the two are to be disengaged, spring 6 is pressed downward by rod 8 passing through hole 7, such that spring 6 no longer butts against the edge of surface 4'.

This allows the whole latch to be translated to the right until lip 2 clears surface 4, after which the latch can be lifted out, left end first.

When the latch is to be inserted in the aperture, the above process is employed, in reverse order.

Besides the quick release attribute, this latch has a relatively fool-proof construction as regards malicious mischief. There are no screws employed by which the latch could be removed by removing the screws, and the purpose and required manipulation of spring 6 by rod 8 is obscure.

Spring 6 has a slightly concave upward form so that when it is pressed downward by rod 8 the free end portion will have a parallel to the plane of surface 4 relation and thus must easily avoid that surface in the movement of the latch to the right in the in-and-out manipulations.

I claim:

1. In combination, (a) a latch structure (1) having first (2) and second (3) extending lips, and (b) a seat arm (4,4') having a planar aperture (5,5') smaller than the extending lips of said latch structure, (c) a leaf spring (6) below said latch structure abutting an edge (5') of said aperture, (d) an orifice (7) axially perpendicular to said leaf spring, and (e) a rod (8) translatable within said orifice to move said leaf spring away from the plane of the aperture, for allowing translation of said latch structure within said aperture for removing said latch structure from said aperture.

2. The combination of claim 1, in which;

(a) said first extending lip (2) lies wholly parallel to said seat arm (4).

3. The combination of claim 1, in which;

(a) said second extending lip (3) is spaced from said seat arm (4') except at the free end of the second extending lip (3).

4. The combination of claim 1, in which;

(a) the spaced portion of said second extending lip allows said leaf spring (6) to be moved away from the plane of the aperture.

5. The combination of claim 1, in which;

(a) said planar aperture is essentially the same width as the width of said latch structure.

* * * * *